US005875891A

United States Patent [19]

Snell

[11] Patent Number: 5,875,891

[45] Date of Patent: Mar. 2, 1999

[54] PACKAGING FOR GOLF BALLS

[75] Inventor: Dean A. Snell, Oceanside, Calif.

[73] Assignee: Taylor Made Golf Company, Inc., Carlsbad, Calif.

[21] Appl. No.: 853,652

[22] Filed: May 9, 1997

[51] Int. Cl.[6] ..... B65D 85/58

[52] U.S. Cl. ..... 206/315.9; 206/579; 53/471

[58] Field of Search ..... 206/315.1, 315.9, 206/315.91, 579, 504, 459.5; 220/461; 229/3.1; 53/471, 478

[56] References Cited

U.S. PATENT DOCUMENTS

| | | | |
|---|---|---|---|
| 1,050,706 | 1/1913 | Taylor | 206/315.9 |
| 1,421,955 | 7/1922 | Kemp | 206/315.9 |
| 3,819,040 | 6/1974 | Coons | 206/315.9 |
| 4,258,847 | 3/1981 | Nierman | 206/504 |
| 4,349,124 | 9/1982 | Faller | 229/3.1 |
| 4,553,667 | 11/1985 | Hudson et al. | 206/315.9 |
| 5,253,871 | 10/1993 | Viollaz . | |
| 5,433,491 | 7/1995 | Green | 206/315.9 |
| 5,511,666 | 4/1996 | Grip | 206/315.9 |
| 5,641,064 | 6/1997 | Goserud | 206/315.1 |

FOREIGN PATENT DOCUMENTS

| | | |
|---|---|---|
| 7187268 | 7/1995 | Japan . |
| 2280379 | 1/1995 | United Kingdom . |

*Primary Examiner*—Paul T. Sewell
*Assistant Examiner*—Luan K. Bui
*Attorney, Agent, or Firm*—Knobbe, Martens Olson & Bear, LLP

[57] ABSTRACT

A packaging for golf balls that acts as a moisture barrier inhibiting moisture absorption by a golf ball during storage. In one embodiment, the packaging includes a sealing member that defines an internal closed volume that is configured to receive a golf ball. The sealing member preferably has a laminate structure that includes a moisture barrier layer, a sealing layer and a structural layer. Another aspect is a method of packaging golf balls to minimize moisture absorption during storage.

49 Claims, 5 Drawing Sheets

PACKAGING FOR GOLF BALLS

BACKGROUND OF THE INVENTION

1. Field of the Invention

The present invention relates to an improved packaging for golf balls, and more particularly, relates to a golf ball packaging that preserves the mechanical and physical characteristics of the ball during storage and transport.

2. Description of the Related Art

Golf balls generally come in two different varieties, solid golf balls and multi-piece golf balls. A solid golf ball consists of a polymeric sphere having a plurality of molded dimples which aid the flight characteristics of the golf ball. Solid golf balls are usually used for practicing, where high performance is not a priority, such as in driving ranges. Multi-piece golf balls exhibit better playing characteristics than solid golf balls and are consequently usually used on golf courses during play. A multipiece golf ball consists of either a wound or solid rubber core that is covered with a separate and distinct cover. The cover often comprises a single thermoplastic layer. Recently, new types of multi-piece golf balls have been introduced having a multilayered compound including a plastic mantle surrounding a solid polybutadiene rubber core and an external thermoplastic envelope. The solid core or the center of a wound core is generally made of an elastomer, such as a CIS content polybutadiene rubber which is combined with a zinc or other metal salt of unsaturated fatty acid. Often, small amounts of zinc oxide are also added to the core in order to achieve a higher performance in restitution, as described below.

The cover of a multi-piece golf ball is typically made from a material that contributes to the durability of the ball and also provides the particular "feel" characteristics of the ball when struck with a club. By way of example, a two-piece golf ball construction of a rubber core and an ionomer cover generally provides a very durable ball and also provides maximum travelling distance to the ball when struck with a club.

Golf ball manufacturers have recently introduced a new type of two-piece golf ball for use by the Tour players. The new golf balls provide a softer feeling to the ball when struck with a club. Manufacturers have achieved this characteristic by lowering the core compression and softening the cover of the golf ball. Golf ball manufacturers have also recently developed a three-layer golf ball having an intermediate mantle between the core and the cover. The three-layer golf ball provides a softer feel to the golf ball while also providing maximum distance and durability. In such a golf ball, it is advantageous to use a thermoplastic material for the mantle, such as a pure or blended ether block copolymer (e.g., PEBAX®), as is disclosed in U.S. Pat. No. 5,253,871.

Unfortunately, there are certain drawbacks that are associated with prolonged storage of multi-piece golf balls. Multi-piece golf balls typically absorb moisture when they are subjected to prolonged storage under ambient conditions of temperature and humidity. A short period of moisture absorption can cause significant changes in the performance characteristics of the ball. Such moisture absorption may affect the weight of the ball, as well as the physical and mechanical characteristics of the various materials that make up the different pieces of the golf ball structure, including the cover, the core and the mantle.

One other characteristic that is affected by moisture absorption is the initial velocity of the golf ball. United States Golf Association (USGA) rules govern the allowable ranges of initial velocity values for golf balls. According to the USGA rules, the initial velocity must not exceed a value of 250 feet per second, with a maximum tolerance of 2%. Consequently, golf ball manufacturers have striven to manufacture golf balls that have an initial velocity as close as possible to the 255 feet per second limit without exceeding this value.

Moisture has been shown to significantly affect the initial velocity value of a ball over a very short period of time. FIG. 1 is a graph that plots the initial velocity value as a function of time for a stored golf ball at various ambient conditions. As shown in FIG. 1, the initial velocity loss is approximately 2.5 ft/sec. over twelve months for golf balls having a soft cover, between 50 to 60 shore D, in an environment of 72° F. and 50% of relative humidity (RH). Such a initial velocity loss of 2.5 ft/sec corresponds to a loss of distance of approximately 6 to 10 yards when the ball is struck with a driver. For a golf ball having a hard cover, between 68–72 shore D in the same conditions, the initial velocity loss over 12 months is approximately 0.5 ft/sec.

The problem of moisture absorption is particularly critical for soft cover balls because the soft cover is more permeable to moisture than a hard cover, so the moisture reaches the core more easily. Because it is made of a highly hygroscopic material, the core absorbs this moisture, which degrades the core's desired properties. The degradation in performance characteristics is generally accelerated when the ambient storage temperature becomes higher. For a soft cover ball at a temperature around 110° F. and 50% RH, a velocity loss of 2.5 ft/sec occurs in only few weeks, as opposed to twelve months for a soft cover ball in an environment of 72° F. and 50% RH. During transportation of the golf balls from the manufacturing facility to a retail store, actual storage conditions are closer to these conditions. Consequently, soft cover balls may experience a large reduction in performance characteristics when being transported from the manufacturing facilities to the retail store.

Three-layered golf balls also encounter a similar problem with moisture absorption. A three-piece golf ball including a polyamide-base mantle, such as PEBAX®, is sensitive to water absorption. The characteristics of such a golf ball can change significantly during a short period of time if the ball absorbs moisture. In particular, the characteristics of hardness, weight, volume, tensile strength, elongation, resiliency, and modulus can vary significantly after a prolonged stay in ambient conditions and be worse in humid and warm conditions.

Golf ball manufacturers have proposed various golf ball structural configurations in an effort to inhibit moisture absorption. United Kingdom Patent Application 2,280,379 proposes to include in the golf ball structure a moisture barrier layer that has a lower water vapor transmission rate than the golf ball cover. The golf ball includes a cover that has a thickness of at least 30 mils and a continuous moisture barrier layer that surrounds the inner core. While this golf ball is designed to increase the shelf life of a ball by inhibiting moisture absorption, it also presents many drawbacks. First, the moisture barrier layer is generally made of a material that does not readily adhere to the adjacent materials in the golf ball structure. Consequently, the various layers of the golf ball structure may move relative to one another, such as through rotation. As a result of this lack of adhesion between the layers, the spin rate of the ball is reduced since the momentum transferred to the ball is significantly less than if the inner layers initially moved at the same rate as the outer layers. Second, the acceptable thickness of the moisture barrier layer is limited, as the characteristics of the ball would be adversely affected if the barrier layer constituted a major portion of the ball structure. Consequently, the moisture barrier layer must be made relatively thin. However, if it is made too thin, the moisture barrier layer will not sufficiently inhibit moisture absorption, so that the moisture barrier layer must generally be used in conjunction with a cover that is relatively thick, which may be undesirable.

United Kingdom Patent Application 2,280,379 also discloses a golf ball having a moisture barrier layer positioned outside the golf ball clear coat. The clear coat is a solution that is applied to the outer surface of a golf ball to protect the ball and to add an aesthetically pleasing appearance by providing the ball with a high gloss and mirror-like finish. Unfortunately, positioning the moisture barrier layer outside the clear coat is undesirable since it may subject the moisture barrier layer to damage during use. Another drawback associated with placing a water barrier around the clear coat is that the barrier layer significantly reduces the clear coat's transparency and glossy appearance. This may adversely affect the appearance of identifying indicia, such as trademarks, logos, model names, etc., that are often placed on the golf ball. Finally, the golf ball of U.K. Application 2,280,379 is complicated to manufacture and involves steps for which special precautionary measures are required. For example, the core is dipped in a solvent solution, such as toluene, which is a known toxic and cancer-causing chemical.

Japanese Patent Application No. 7-187268 discloses a packaging for golf balls. The packaging is made of a heat-shrinkable film that is shrunk over golf balls for storage. The film enables the golf balls to be arranged in a tight configuration of lines or rows. Perforations are made in the film to facilitate the evacuation of air during the process of heat-shrinking the film. While this type of packaging eliminates bulk by enabling a collection of golf balls to be tightly packed, it does not address the problem of moisture absorption by the golf balls after they are packed and during storage. The packaging disclosed in JPA 7-187268 does not act as a moisture barrier, as the perforations in the packaging make it permeable to moisture.

Currently, manufacturers pack golf balls that are available on the market in rigid paper or cardboard boxes. Such packaging is highly susceptible to moisture penetration and, therefore, moisture absorption by the golf balls. As discussed above, such moisture absorption greatly reduces the performance characteristics of the ball.

There is therefore a need for a packaging that may be used to store golf balls prior to first use and prevent the damage associated with difficult storage and shipping conditions, such as temperature and moisture. Such a packaging should sufficiently protect the golf ball to ensure the freshness of the golf ball and preserve the optimum properties of the golf ball prior to first use, while also preserving and protecting the structure of the ball. The packaging should be both capable of protecting single or multiple golf balls and retaining the physical and mechanical properties of the ball, such as the initial velocity value, until the packaging is opened.

SUMMARY OF THE INVENTION

The aforementioned needs are satisfied by the present invention which is an improved golf ball packaging that sufficiently protects the structure of the ball during storage and also inhibits moisture absorption in the golf ball.

One embodiment of the invention relates to a golf ball and package assembly, comprising at least one golf ball and a package separable from the golf ball. The package defines a cavity within which the golf ball is positioned, the package including a sealing member at least a portion of which comprises a moisture barrier which completely surrounds the golf ball. The moisture barrier acts as a barrier to moisture vapor transmission. Desirably, the sealing member forms a substantially airtight seal around the cavity. In a preferred embodiment, the portion of the sealing member has an average moisture vapor transmission rate roughly less than about 0.2 grams per 100 square inches per day at 100 degrees Fahrenheit and 90% relative humidity.

In another embodiment, the package desirably defines a plurality of cavities, each of which are sized and shaped to receive a golf ball. Each of the plurality of cavities is advantageously sealed from one another. The package may further comprise tear lines to facilitate the separation of a portion of the package defining at least one cavity sized and shaped to receive a golf ball from another portion of the package defining at least one cavity sized and shaped to receive a golf ball.

The invention also relates to a package for at least one golf ball. The package comprises a sealing member defining a cavity sized and shaped to receive a golf ball. At least a portion of the scaling member comprises a continuous moisture barrier completely surrounding the cavity, the portion acting as a barrier to moisture vapor transmission. The sealing member preferably forms a substantially airtight seal around the cavity.

In one embodiment, the cavity generally conforms to the size and shape of a golf ball. The cavity may contain a volume of gas having a very low humidity in order to limit the amount of initial moisture within the cavity. Advantageously, the sealing member comprises multiple layers. The multiple layers desirably comprise a sealant layer and a support layer.

In yet another embodiment, the package comprises a rigid structural member and the cavity has a diameter which generally conforms to the size of a golf ball. The cavity desirably contains a volume of gas having a very low humidity. The humidity of the dry gas is preferably less than 15% at a temperature of 70° Fahrenheit.

There is also disclosed a method for packaging a golf ball, comprising the steps of positioning a golf ball within a sealing member at least a portion of which comprises a continuous moisture barrier and sealing the sealing member such that the golf ball is completely sealed within a cavity formed by the continuous moisture barrier.

BRIEF DESCRIPTION OF THE DRAWINGS

These and other features of the invention will now be described with reference to the drawings of a preferred embodiment, which are intended to illustrate and not to limit the invention, and in which.

DETAILED DESCRIPTION OF THE PREFERRED EMBODIMENT

Figure 1:
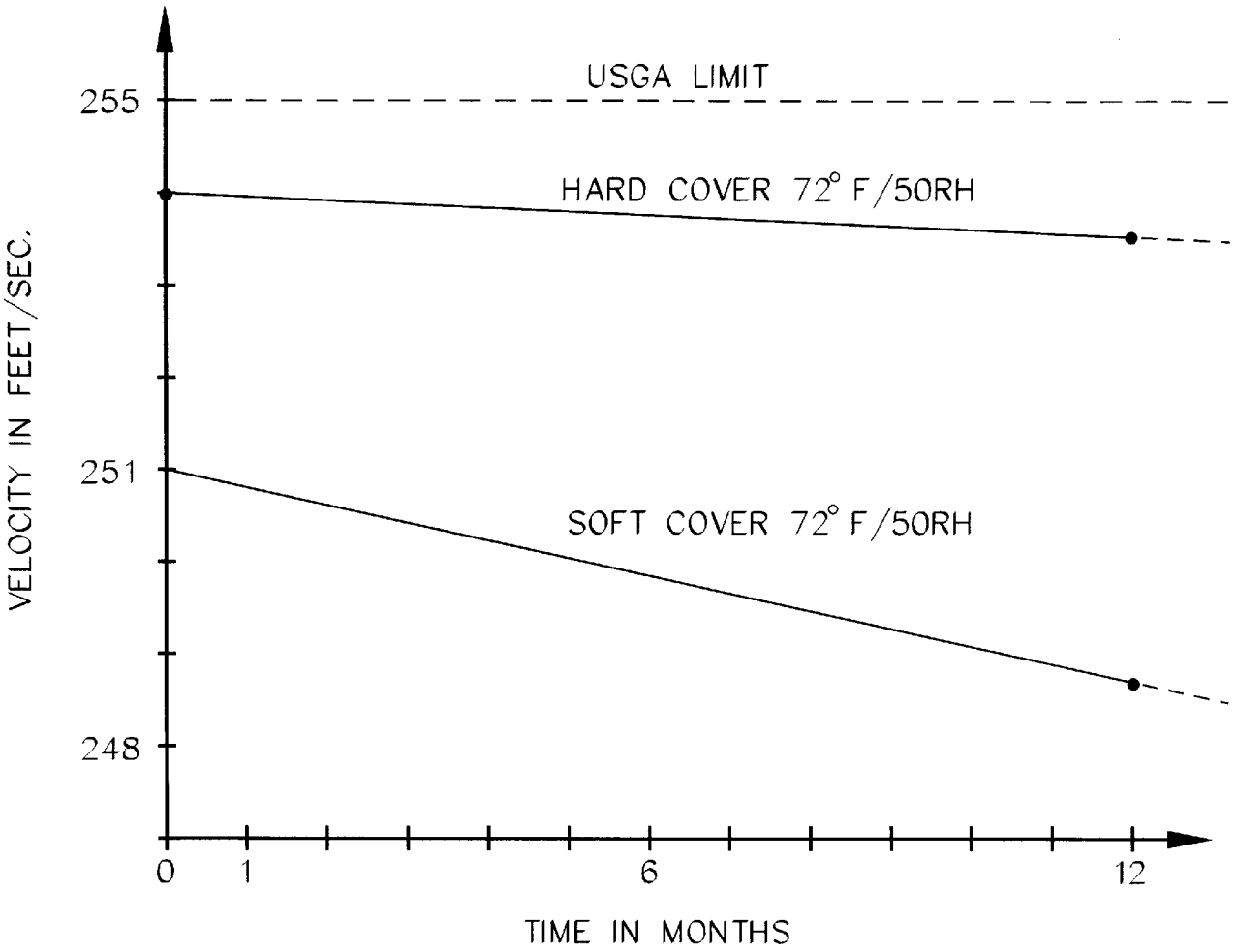
FIG. 1 is a graph showing the variation of the velocity of a golf ball as a function of storage time for various types of golf balls under same ambient conditions.
Figure 2:
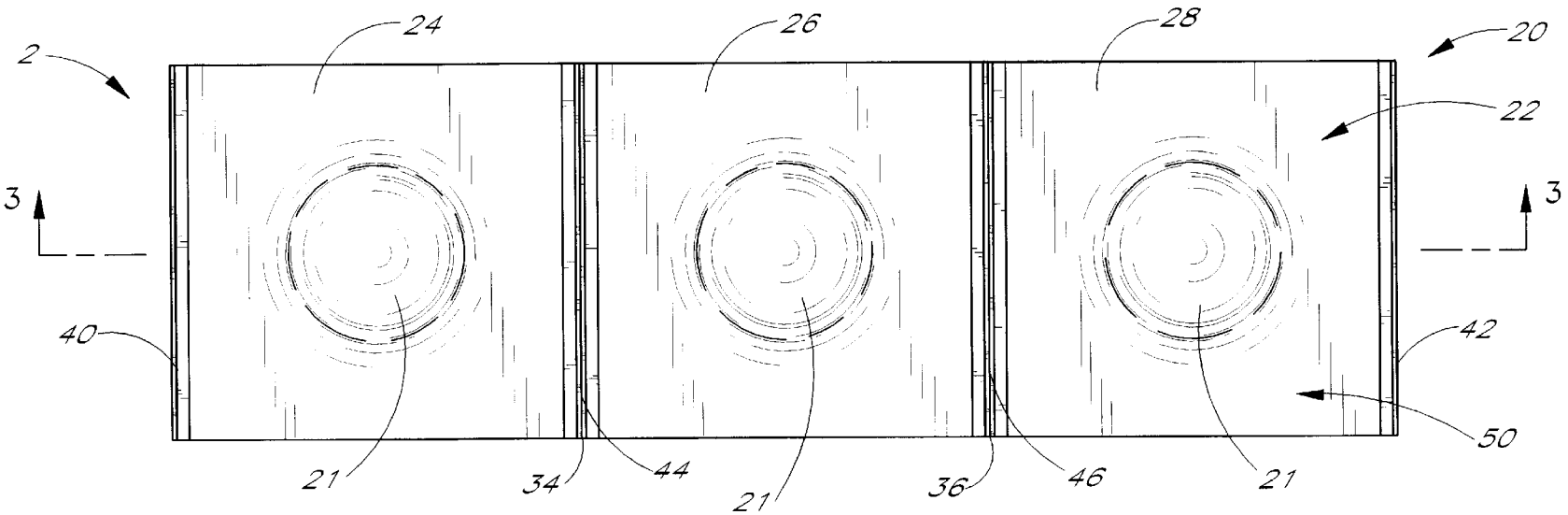
FIG. 2 shows an elevational view of a packaging for golf balls configured in accordance with the present invention.
Figure 3:
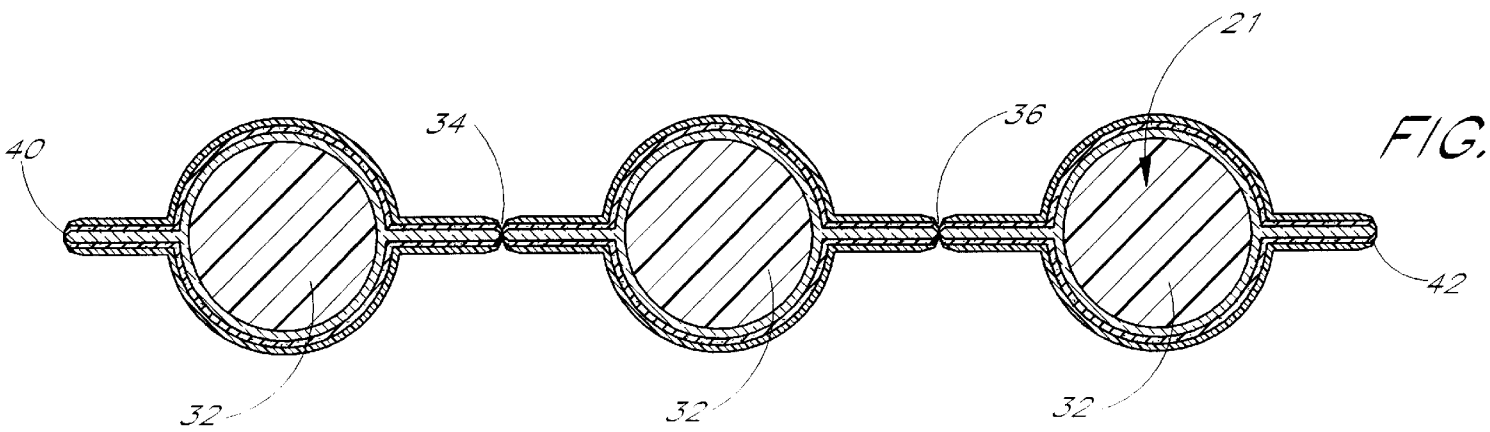
FIG. 3 is a cross-sectional view of the packaging shown in FIG. 2 taken along 3—3 of FIG. 2.

FIGS. 2 and 3 illustrate a first embodiment of a golf ball packaging 20 of the present invention. FIG. 2 is a top view of the packaging 20 and FIG. 3 is a cross-sectional view of the packaging 20 taken along the line 3—3 in FIG. 2. In the illustrated embodiment, the golf ball packaging 20 is configured to enclose a plurality of golf balls 21 for storage or transport. The packaging 20 advantageously inhibits moisture transmission so as to protect the enclosed golf ball from the damage associated with moisture, as described in detail below. Because the packaging inhibits moisture transmission, it may be used for prolonged storage of golf balls where the desired performance characteristics of the ball are preserved.

Referring to FIG. 2, the packaging 20 includes a sealing member 22 that is comprised of a collection of individual member portions 24, 26, 28, each defining a cavity 32 (FIG. 3). The cavities 32 preferably have a size and shape that conforms to the size and shape of a golf ball. Each of the cavities 32 in the member portions 24, 26, 28 is hermetically divided from one another other and contains a single golf ball 21. In accordance with the present invention, the sealing member 22 acts as a moisture barrier which prevents water and water vapor from entering the cavities 32. During packaging of the golf balls within the sealing member 22, a vacuum is preferably pulled between the sealing member 22 and the golf balls in order to ensure a minimum amount of humidity on the golf ball surface. Preferably, the packaging is performed under dry-air conditions in order to minimize the amount of initial humidity within the cavity 32.

As best shown in FIG. 2, a sealing joint 34 separates the first member portion 24 from the second member portion 26. A second sealing joint 36 separates the second member portion from the third member portion 28. Sealing joints 40 and 42 also located on the left and right outer edges, respectively, of the sealing member 22. As used herein, reference to the terms "left" and "right" are with respect to the illustrations contained herein and are not intended to limit the scope of the invention.

As shown in FIG. 2, a tear line 44, such as series of perforations or other area(s) of reduced strength, is aligned with the sealing joint 36 on the sealing member 22. A second tear line 46 is aligned with the sealing joint 36 between the second member portion 26 and third member portion 28. Preferably, the tear lines 44 and 46 are produced along each of the sealing joints 34 and 36 in order to facilitate the separation of any of the member portions 26, 28, 24 from each other. Although FIGS. 2 and 3 illustrate the sealing member 22 as having a row of three member portions 24, 26, 28, those skilled in the art will appreciate that any number of separate member portions may be arranged in the sealing member 22 in any of a wide variety of spatial relationships.

Figure 4:
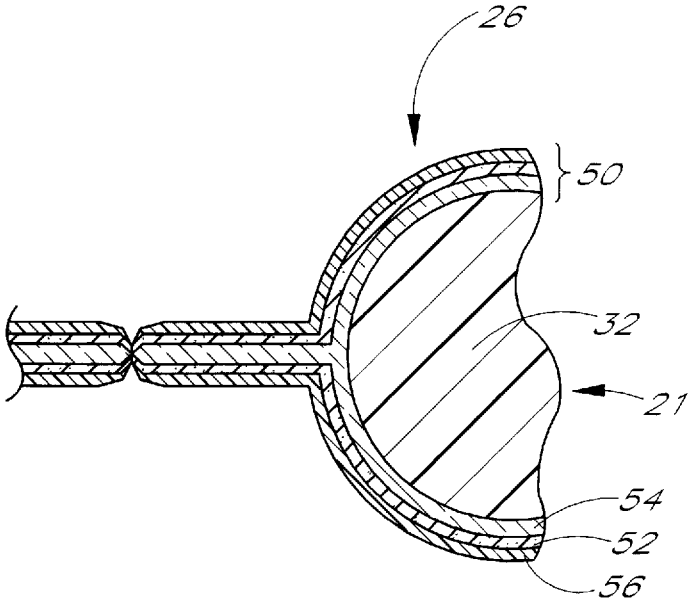
FIG. 4 is an enlarged cross-sectional view of a portion of the packaging shown in FIG. 2.

FIG. 4 illustrates a side cross-sectional view of a portion of the member portion 26. As shown, the sealing member 22 is comprised of a thin sheet material 50. The sheet material 50 is preferably a composite structure, such as a multi-layer film or laminate structure that includes a plurality of functional film layers. The various layers that make up the composite structure may be selected to each provide improved physical properties to the sheet material. The preferred embodiment of the sheet material 50 consists three separate layers, each providing certain characteristics. Specifically, the sheet material includes a moisture barrier layer 52, a sealant layer 54, and a mechanical support layer 56, as described below. Those skilled in the art will appreciate that the sheet material 50 could include a wide variety of layers of various materials.

As discussed, the sheet material 50 includes a distinct sealant layer 54 that is preferably made of a heat sealable polymer material, such as a thermoplastic material. Such a material may be melted to aid in the production of the sealing joints 34, 36, 40, 42 in the sheet material 50. In a preferred embodiment, the sealant layer 54 is the innermost layer in the sheet material 50 (i.e., the layer that lies directly adjacent the cavity 32).

The sheet material 50 also includes a moisture barrier layer 52 that lies adjacent the sealant layer 54. The moisture barrier layer 52 inhibits the passage of moisture through the sheet material 50 and into the cavity 32. The moisture barrier layer 52 is preferably made of a material that is both stretch and heat resistant so that the moisture barrier layer 52 is not degraded during the vacuum step and sealing step of manufacturing. Moisture barriers of the invention desirably have a very low water vapor transmission rate. The effectiveness of the moisture barrier layer 52 depends upon its composition and its thickness. Suitable moisture barriers layers preferably have an average moisture vapor transmission rate of less than about 0.2 grams per 100 sq. in. per day at 100° F. and 90% relative humidity. Although a transmission rate of 0.4 grams per 100 square inches per day at 100° F. and 90% relative humidity would be a significant improvement over existing golf ball packaging. Generally speaking, the thicker the layer for a given material the better the moisture barrier characteristics it will have. While it is desirable to have a relatively thin barrier to minimize size and weight, this will, of course, need to be balanced against the cost of the material.

One advantage of the present invention is that the thickness of the moisture barrier layer 52 does not influence the characteristics of the ball as it does when a moisture barrier layer is integrated directly within the structure of the ball, as taught in UK Patent 2,280,379. Accordingly, the thickness of the moisture barrier layer 52 can be selected to maximize the moisture barrier characteristics without affecting the performance characteristics of the golf ball 21.

The moisture barrier layer 52 of the present invention may be manufactured of a wide variety of materials, such as polymers, reinforced polymers, metals or any combination thereof. In the preferred embodiment, the moisture barrier layer is selected from the group comprising polyolefine, polyamide, ethylene vinyl alcohol polyester, polyacrylonitrile, (poly)vinylidene chloride, fluorocarbon polymer, as well as any blend of these materials, and metal. A thin and flexible metallic foil, such as aluminum foil, can also serve as a moisture barrier. The metallic foil is preferably adhered to a flexible plastic or paper support layer to obtain the flexible sealing member 20, as described below. Well known techniques may be used to adhere the metallic foil to a plastic or cellulosic layer, such as physical or chemical vapor deposition, adhesion by hot pressing with an adhesive film, etc. Another technique for plastics consists of deposition of molten thermoplastic on a thin aluminum foil.

As shown in FIG. 4, the sheet material 50 may also include a support layer 56, which preferably is the outermost layer in the sheet material 50. The support layer 56 provides mechanical resistance to the laminate structure of the sheet material 50 against damaging effects, such as scratching, abrasion, heat and cutting, etc. One benefit associated with using a support layer 56 in the sheet material 50 is that it allows the use of a layer comprised of a less expensive material that provides mechanical resistance against damage to the sheet material 50. Moreover, because the support layer 56 provides the mechanical resistance properties to the sheet material 50, the moisture barrier layer 52 may be dedicated specifically to prevent moisture transmission and may therefore be comprised of a material having very high moisture barrier effects but poor mechanical resistance properties. Examples of material suitable for the support-layer 50 are chosen among the polyolefines such as polyethylene, polypropylene, polybutylene, and ionomers.

A specific high oxygen barrier layer (not shown) can also be used within the sheet material 50 between the support layer and the sealant layer 54 in order to preserve the vacuum inside the packaging 20.

The laminate sheet material 50 may be manufactured using a co-extrusion process or by other suitable techniques such as hot pressing, calendaring, etc. Those skilled in the arts will appreciate that any wide variety of processes may be used to manufacture the laminate sheet material 50. Thin layers of adhesive or primer that promote adhesion between each layer can also be used when necessary. The sheet material 50 may be transparent or translucid or may also be colored using inks, pigments, or any other wide variety of coloring materials or techniques. Moreover, indicia such as trademarks, logos, or other decorative features may be located on the sheet material 50.

Figure 5:
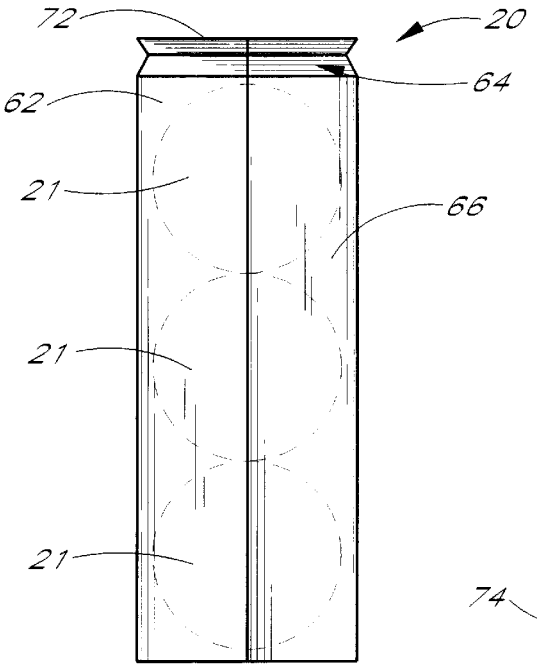
FIG. 5 is a side view of an alternative embodiment of the packaging of the present invention.

FIGS. 5–8 illustrate a second embodiment of the packaging 20 of the present invention. Referring to FIG. 5, the packaging 20 includes an externally rigid structural member 62 having a canister-like configuration. The structural member 62 has a substantially elongated shape and preferably acts as a self-sufficient moisture barrier to golf balls 21 that are stored within a hollow inner compartment 66. The inner compartment 66 has a size that is large enough to store at least one golf ball 21. Desirably, the compartment 66 has a diameter which generally corresponds to the size of the golf ball to allow the size of the packaging to be minimized.

Figure 6:
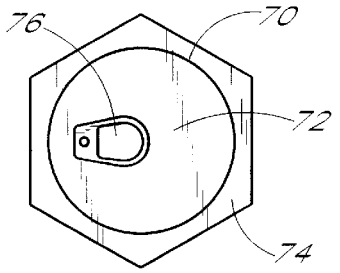
FIG. 6 is a top view of the packaging of FIG. 5.
Figure 7:
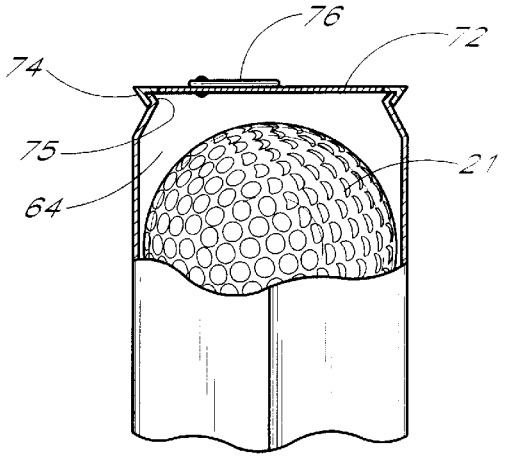
FIG. 7 is a perspective view showing a plurality of the containers of golf balls packaged as illustrated in FIG. 5.

FIGS. 6 and 7 illustrate a top view and partial cross-sectional view of a top portion of the structural member 62. As used herein, the term "top" is with reference to the views of the enclosed drawings and is not intended to limit the scope of the invention. An opening 64 extends through the top of the structural member 62. The opening 64 preferably has a circular shape that is large enough to allow the passage of a golf ball 21 therethrough. A sealing cap 72 is positioned on the top of the structural member 62 over the opening 64. The sealing cap 72 has a shape that conforms to the shape of the opening 64 so that the sealing cap 72 hermetically seals the opening 64.

As shown in FIG. 7, in a preferred embodiment, the sealing cap 72 has an edge 74 that bends inward toward the structural member 62. The edge 74 runs along the entire perimeter of the sealing cap 72. The structural member 62 has an outwardly bending top edge 75 that corresponds to the inward bend of the edge 74 on the sealing cap 72. The bent edge 74 on the sealing cap 72 overlaps the top edge 75 of the structural member 64. The overlapping portion constitutes a connection that is hermetically sealed by welding or other well known sealing process. The sealed connection between the sealing cap 72 and the structural member 62 advantageously prevents moisture from passing into the inner compartment 66 through the opening 64.

A pull tab 76 is attached to the outer surface of the scaling cap 72. A user opens the structural member 62 by pulling on the pull tab 76 to thereby break the seal between the sealing cap 72 and the structural member 62 and remove the sealing cap 72. The golf balls 21 may then be removed from the structural member 62 through the opening 64.

Figure 8:
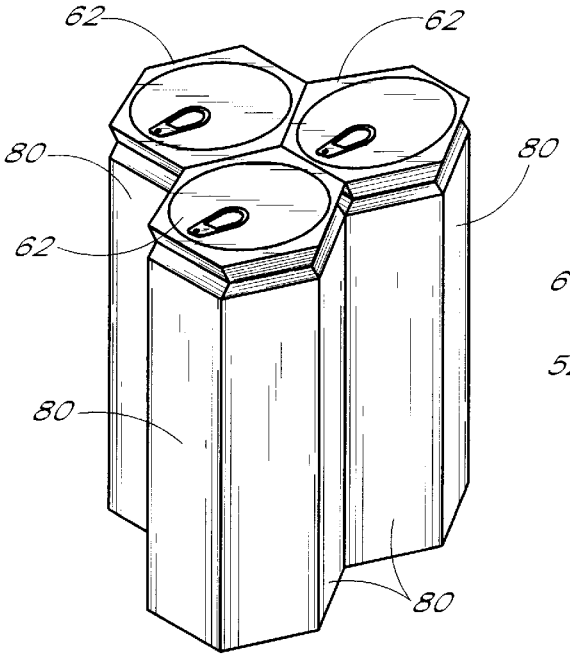
FIG. 8 is a side view, shown in partial cross-section, of the packaging of FIG. 5.

Referring to FIG. 8, the preferred embodiment of the structural member 62 has an outer perimeter shape that conforms to a regular polygon, such as a rectangular, hexagonal or octagonal polygon shape. The outer surface of the structural member 62 therefore includes a plurality of elongated and substantially planar surfaces 80. Such a shape advantageously facilitates the compact arrangement of many elongated bodies 62 together. This is accomplished by aligning the planar surfaces 80 of separate elongated bodies 62 flush against one another. This arrangement allows the elongated bodies 62 to be packed close together during storage in order to save space.

The structural member 62 is preferably made of a lightweight material such as aluminum or plastic. Golf balls 21 are preferably packaged within the structural member 62 under a humidity-controlled atmosphere to ensure that the inner compartment 66 of the structural member 62 has a relative humidity value that does not adversely affect the mechanical and physical properties of the golf balls 21.

Figure 9:
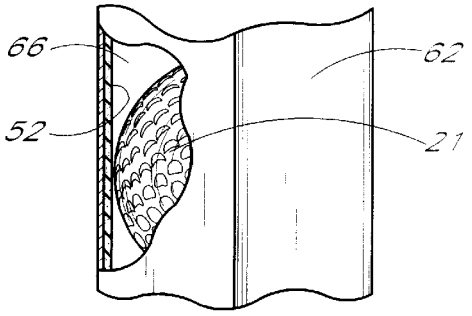
FIG. 9 is a side view, shown in partial cross-section, of an alternative embodiment of the packaging of FIG. 5.

FIG. 9 illustrates a side view of the structural member 62. A portion of the structural member 62 is shown in cross-section to clearly illustrate the structural makeup of the packaging 20. In certain cases, the structural member 62 may be manufactured of a material, such as a plastic, that offers mechanical support for transport and storage and is cost efficient but does not act as an efficient moisture barrier. The structural member may also be manufactured of a material such as cardboard or other rigid material that is lightweight but permeable to moisture. In such cases, the material that is used to manufacture the structural member 62 does not constitute a self-sufficient moisture barrier. Hence, a specific moisture barrier layer 52, such as described above, is laminated to the inner surface of the structural member 62. The moisture barrier layer 52 preferably adheres directly to the interior surface of the structural member 62. Alternatively, the moisture barrier layer 52 may be glued using an adhesive film (not shown). The moisture barrier layer 52 advantageously provides an otherwise moisture permeable material with moisture barrier qualities.

Figure 10:
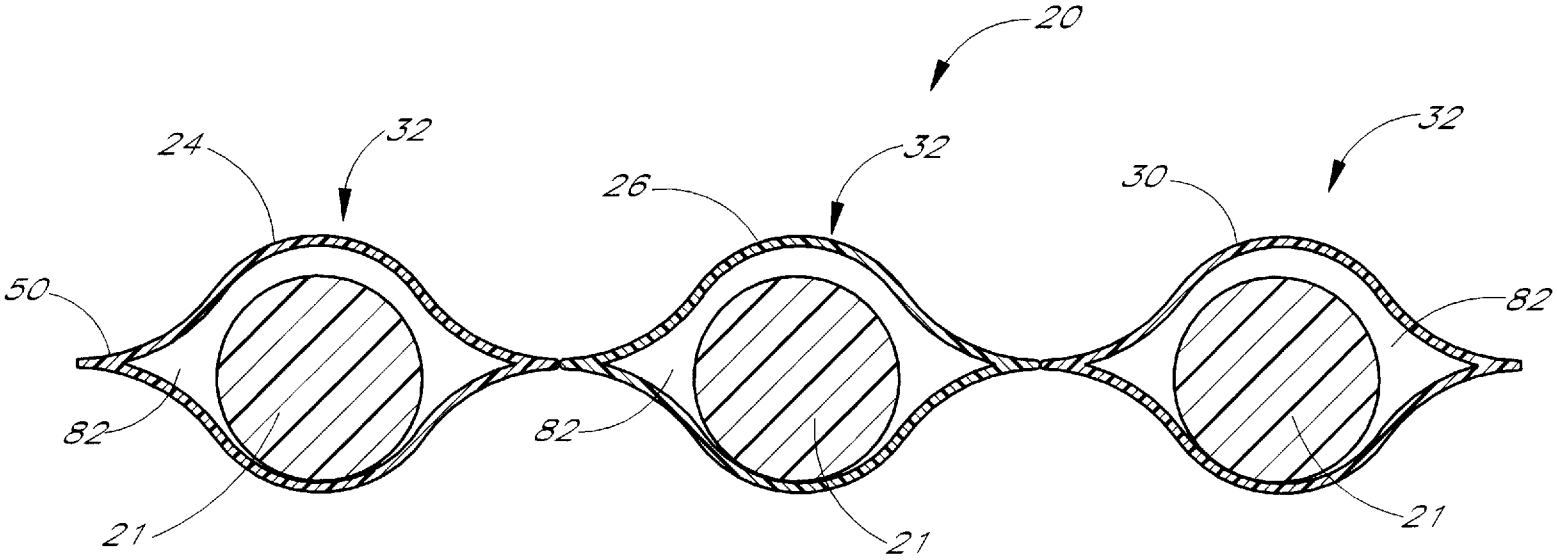
FIG. 10 illustrates a cross-sectional side view of yet another embodiment of the present invention.

FIG. 10 illustrates yet another embodiment of the golf ball packaging 20. The golf ball packaging 20 illustrated in FIG. 10 is substantially identical to the golf ball packaging 20 that is illustrated in FIGS. 2–4. However, in this embodiment, the space within the cavity 32 that lies between the golf ball 21 and the inner wall of the sheet material 50 is filled under normal atmosphere or pressurized with a dry gas 82 of a very low relative humidity. The gas 82 can be dried using well-known techniques, such as condensation of the humidity at a low temperature until the dew point of the gas 82 is reached. The gas 82 preferably assists the sealing member in reducing the likelihood the golf balls 21 being exposed to harmful moisture.

The packaging 20 of the present invention is therefore an efficient storage device for golf balls. The packaging 20 advantageously preserves the designed performance characteristics of golf balls by inhibiting exposure of the golf ball to moisture during storage and transport. The packaging 20 is comprised of a material that includes a moisture barrier layer, thereby eliminating the need to manufacture a moisture barrier layer directly in the golf ball structure, which can reduce golf ball performance and increase manufacturing costs.

When used in conjunction with the support layer 56, the packaging preserves both the performance specifications of the packaged golf ball and the structure of the ball. The packaging 20 may advantageously be used for prolonged storage of a golf ball or a collection of golf balls without concern moisture absorption. Hence, a golf ball that is stored within the packaging of the present invention may be designed to maximize performance. The designed performance characteristics of the ball are not degraded when the ball is first used, as is often the case with current golf ball packaging.

Although the foregoing description of the preferred embodiment of the preferred invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A golf ball and package assembly, comprising:

at least one golf ball;

a package separable from said golf ball defining a cavity within which said golf ball is positioned, said package including a sealing member at least a portion of which comprises a moisture barrier which completely surrounds said golf ball and wherein said portion of said sealing member has an average moisture vapor transmission rate roughly less than about 0.4 grams per 100 square inches per day at 100 degrees Fahrenheit and 90% relative humidity.

2. The assembly of claim 1, wherein said portion of said sealing member has an average moisture vapor transmission ate roughly less than about 0.2 grams per 100 square inches per day at 100 degrees Fahrenheit and 90% relative humidity.

3. The assembly of claim 1, wherein said package defines a plurality of cavities, each of which are sized and shaped to receive a golf ball.

4. The assembly of claim 3, wherein each of said plurality of cavities is sealed from one another.

5. The assembly of claim 3, wherein said package further comprises tear lines to facilitate the separation of a portion of said package defining at least one cavity sized and shaped to receive a golf ball from another portion of said package defining at least one cavity sized and shaped to receive a golf ball.

6. The assembly of claim 1, wherein said sealing member comprises a composite structure.

7. The assembly of claim 5, wherein said sealing member comprises multiple layers.

8. The assembly of claim 6, wherein said sealing member additionally includes a sealant layer.

9. The assembly of claim 7, wherein said sealing member additionally includes a support layer to provide the package with mechanical resistance against damage.

10. The assembly of claim 8, wherein said sealing member additionally includes a high oxygen barrier layer.

11. The assembly of claim 1, wherein said sealing member is transparent or translucid.

12. The assembly of claim 1, wherein said sealing member further comprises indicia.

13. The assembly of claim 1, wherein said package comprises a rigid structural member.

14. The assembly of claim 12, wherein said sealing member comprises said rigid structural member.

15. The assembly of claim 12, wherein said rigid structural member defines an opening communicating with said cavity, said opening sized and shaped to permit the passage of a golf ball therethrough.

16. The assembly of claim 14, wherein said package further comprises a removable cover hermetically sealing said opening.

17. The assembly of claim 15, wherein said structural member has an outer shape which conforms to a regular polygon to facilitate compact shipping and storage of multiple packages together.

18. The assembly of claim 1, wherein said cavity contains a volume of gas having a very low humidity.

19. The assembly of claim 18, wherein said humidity of said dry gas comprises less than 15% at a temperature of 70° Fahrenheit.

20. The assembly of claim 1, wherein said cavity generally conforms to the size and shape of a golf ball.

21. An assembly, comprising:

a golf ball;

a sealing member defining a cavity within which said golf ball is positioned, at east a portion of said sealing member comprising a continuous moisture barrier completely surrounding said cavity, said portion having an average moisture vapor transmission rate roughly less than about 0.2 grams per 100 square inches per day a 100 degrees Fahrenheit and 90% relative humidity.

22. The package of claim 21, wherein said cavity generally conforms to the size and shape of a golf ball.

23. The package of claim 22, wherein vacuum is performed within said cavity.

24. The package of claim 23, wherein said cavity contains a volume of gas having a very low humidity.

25. The package of claim 21, wherein said sealing member defines a plurality of cavities, each of which are sized and shaped to receive a golf ball.

26. The package of claim 25, wherein each of said plurality of cavities is hermetically sealed from one another.

27. The package of claim 26, wherein said sealing member further comprises tear lines to facilitate the separation of a portion of said packaging defining at least one cavity sized and shaped to receive a golf ball from another portion of said package defining at least one cavity sized and shaped to receive a golf ball.

28. The package of claim 22, wherein said sealing member comprises multiple layers.

29. The package of claim 28, wherein said scaling member comprises a sealant layer and a support layer.

30. The package of claim 29, wherein said sealing member comprises a high oxygen barrier layer.

31. The package of claim 22, wherein said sealing member is transparent or translucid.

32. The package of claim 22, wherein said sealing member further comprises indicia.

33. The package of claim 21, wherein said package comprises a rigid structural member and said cavity has a diameter which generally conforms to the size of a golf ball.

34. The package of claim 21, wherein said cavity contains a volume of gas having a very low humidity.

35. The package of claim 21, wherein said sealing member comprises said rigid structural member.

36. The package of claim 33, wherein said rigid structural member defines an opening communicating with said cavity, said opening sized and shaped to permit the passage of a golf ball therethrough.

37. The package of claim 34, wherein said sealing member further comprises a removable cover hermetically sealing said opening.

38. The package of claim 35, wherein said structural member has an outer shape which conforms to a regular polygon, to facilitate compact shipping and storage of multiple packages together.

39. A method for packaging a golf ball, comprising the steps of:

positioning a golf ball within a sealing member at least a portion of which comprises a continuous moisture barrier having an average vapor transmission rate roughly less than about 0.4 grams per 100 square inches per day at 100% Fahrenheit and 90% relative humidity;

sealing said sealing member such that said golf ball is completely sealed within a cavity formed by said continuos moisture barrier.

40. The method of claim 39, further comprising creating a vacuum within said cavity to remove moisture from said cavity.

41. The method of claim 39, wherein said positioning step is performed under dry air conditions to minimize the amount of initial humidity within the cavity.

42. The method of claim 39, additionally comprising the step of filling the cavity with a dry gas having a very low relative humidity.

43. The method of claim 39, wherein the dry gas has a relative humidity of less than 15% at a temperature of 70° Fahrenheit.

44. A golf ball and package assembly, comprising:

at least one golf ball;

a package separable from said golf ball defining a cavity within which said golf ball is positioned, said package including a sealing member at least a portion of which comprises a moisture barrier which completely surrounds said golf ball and prevents essentially all moisture vapor transmission per 100 square inches per day at 100 degrees Fahrenheit and 90% relative humidity.

45. The assembly of claim 44, wherein said sealing member comprises a composite structure.

46. The assembly of claim 45, wherein said sealing member comprises multiple layers.

47. The assembly of claim 46, wherein said sealing member additionally includes a sealant layer.

48. The assembly of claim 47, wherein said sealing member additionally includes a support layer to provide the package with mechanical resistance against damage.

49. The assembly of claim 48, wherein said sealing member additionally includes a high oxygen barrier layer.

* * * * *